United States Patent [19]

Lu

[11] Patent Number: 4,821,795

[45] Date of Patent: Apr. 18, 1989

[54] UNDULATED HEAT EXCHANGER FIN

[75] Inventor: James W. B. Lu, W. Bloomfield, Mich.

[73] Assignee: McCord Heat Transfer Corporation, Walled Lake, Mich.

[21] Appl. No.: 111,263

[22] Filed: Oct. 22, 1987

[51] Int. Cl.[4] ..... F28D 1/04

[52] U.S. Cl. ..... 165/151; 165/161; 165/181

[58] Field of Search ..... 165/151, 161, 160, 158, 165/159, 181

[56] References Cited

U.S. PATENT DOCUMENTS 4,049,048 9/1977 Leedham ..... 165/161
4,691,767 9/1987 Tanaka et al. ..... 165/151

FOREIGN PATENT DOCUMENTS 216187 10/1985 Japan ..... 165/151
6588 1/1986 Japan ..... 165/151
1218635 1/1971 United Kingdom ..... 165/151

*Primary Examiner*—James C. Yeung
*Attorney, Agent, or Firm*—Reising, Ethington, Barnard, Perry & Milton

[57] ABSTRACT

A heat exchanger assembly (10) of the tube-fin type comprises a housing (12), a plurality of tubes (24), and a plurality of fins (26). The fins (26) comprise a generally flat plate (27) and have a plurality of holes (28) therethrough. The tubes (24) extend through the holes (28). The fins (26) further include a plurality of undulations (30). The undulations project outwardly from the plate (27) and are arranged in a plurality of engaging rows (32, 34, 36). The undulations (30) are offset between the rows (32, 34, 36) so that the crests (40) of the undulations (30) are not linear in the direction parallel to the width of the plate (27).

17 Claims, 3 Drawing Sheets

UNDULATED HEAT EXCHANGER FIN

TECHNICAL FIELD

The present invention relates to fins for use in heat exchangers of the fin-tube type.

BACKGROUND ART

Heat exchangers of the tube-fin type are well known in the prior art. Such heat exchangers are particularly well adapted for use as automobile oil coolers because of their light weight and compact size. The fin configuration is of extreme importance for promoting an efficient transfer of heat from the hot fluid to the cooling fluid. Several prior art assemblies disclose different fin configurations, all of which are directed toward the same result: breaking up the boundary layer of hot fluid across the fin to promote turbulence which results in greater heat transfer.

The U.S. Pat. No. 4,300,629 to Hatada et al discloses a tube-type heat exchanger. The fins have a plurality of louver elements thereon. These louver elements are of different heights so that the edges thereof are offset in the direction orthogonal to the plane of the fin. This pattern is for promoting turbulence and more efficient heat transfer.

The U.S. Pat. No. 4,550,776 to Lu issued Nov. 5, 1985 discloses another fin design for use in a tube-fin type heat exchanger. The fin has a plurality of louver groups thereon. The louver groups extend radially from each of the tube openings toward the next adjacent tube opening in each of six directions. The lower groups are arranged in such a manner as to promote mixing in only one direction. That is, the flow is only directed toward one side of the fin. In such an arrangement the flow is not mixed in a lateral direction. Additionally, the crests of the louvers comprise openings and are not interconnected. This reduces the amount of surface area available for heat transfer from the fluid passing over the fin.

The U.S. Pat. No. 2,360,123 to Gerstung et al issued Oct. 10, 1944 discloses an oil cooler. The oil cooler includes a plurality of tubes through which hot fluid passes. Extending within the tubes are corrugated sheets. The crests of the corrugations are bonded to the tubes through which the hot fluid passes. Because the crests are bonded to the tubes, they become integral therewith. This eliminates the crests as in available heat transfer surface. Thus, only the portions between crests are available as a heat transfer surface.

SUMMARY OF THE INVENTION AND ADVANTAGES

According to the present invention, there is provided a heat exchanger assembly of the tubefin type. The assembly comprises a housing, a plurality of fins having a plurality of holes therethrough, and a plurality of tubes adapted for disposition within the housing and extending through the holes. The assembly is characterized by the fins including a plurality of undulations arranged in rows between adjacent of the holes. The undulations are spaced from one another along the rows with the spacing between adjacent undulations varying from one of the rows to the next of the rows.

Accordingly, the present invention provides a fin having a plurality of undulations thereon for inducing turbulence to the flow of fluid over the fin by mixing the flow of fluid in two directions; from side to side of the fin, and laterally, around adjacent crests. This undulation pattern effectively inhibits the formation of a thick boundary layer and results in a more efficient heat transfer than was capable in the prior art.

FIGURES IN THE DRAWINGS

Other advantages of the present invention will be readily appreciated as the same becomes better understood when taken in references to the accompanying drawings wherein.

DETAILED DESCRIPTION OF THE DRAWINGS

Figure 1:
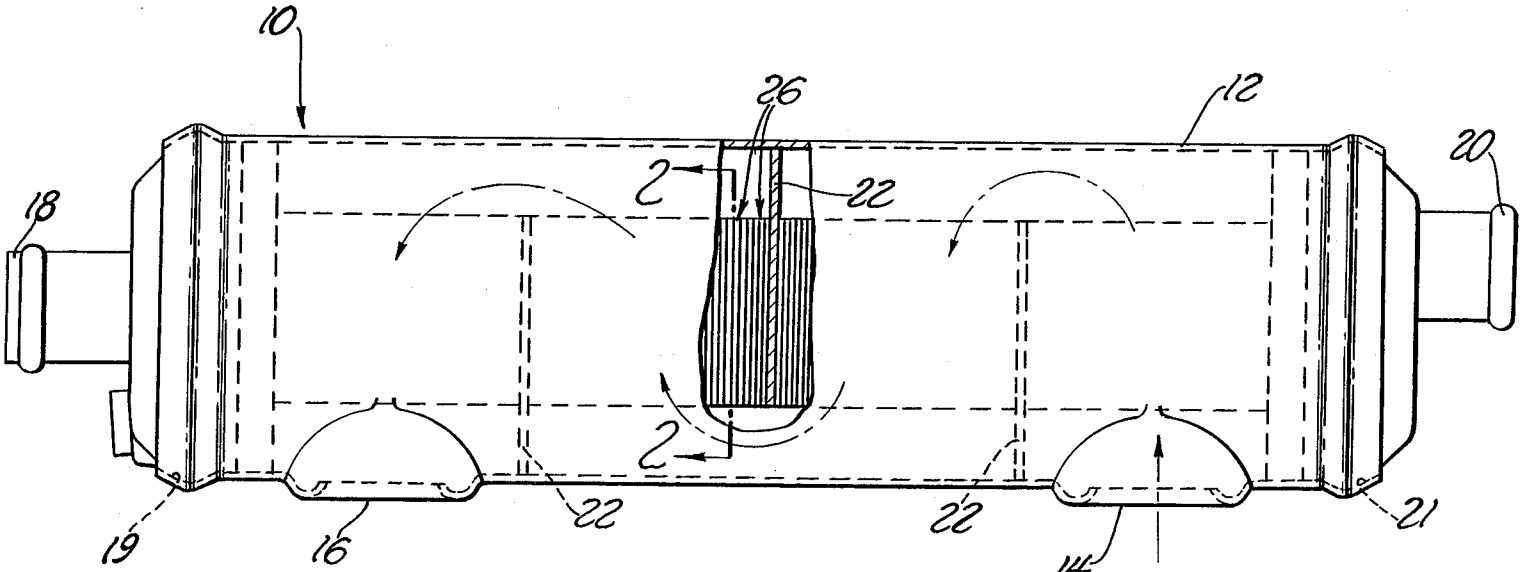
FIG. 1 is a side view, partially broken away and in cross-section of an assembly made in accordance with the present invention.

A heat exchanger of the tube-fin type is generally shown at 10 in figures. The assembly 10 includes a housing 12. The housing 12 is generally cylindrical. The housing 12 includes a hot fluid inlet 14, a hot fluid outlet 16, a cooling fluid inlet 18, and a cooling fluid outlet 20. In the illustrative embodiment shown in FIG. 1, the hot fluid and cooling fluid are shown in a counterflow pattern (i.e., the hot fluid passes through the housing in the opposite direction to that of the cooling fluid). It will be appreciated that hot fluid inlet 14 and hot fluid outlet 16 can be reversed such that the hot fluid flows in the same direction as the cooling fluid. The housing 12 further defines a cooling fluid inlet reservoir 19 and a cooling fluid outlet reservoir 21.

The assembly 10 may also have a plurality of baffles 22 sandwiched therein. The baffles 22 direct the flow of the hot fluid through the housing 12 (as shown by the arrow configuration of FIG. 1). If the assembly 10 does not include any baffle 22, the heat exchanger assembly 10 will be of the single pass type (i.e. the hot fluid will pass directly from the hot fluid inlet 14 to the hot fluid outlet 16 without being directed).

The assembly 10 further includes a plurality of tubes 24. The tubes 24 are adapted for disposition within the housing. The tubes have a substantially circular cross section and extend in a direction parallel to the length of the housing. The tubes are disposed parallel to one another within the housing 12. One end of each of the tubes 24 is in fluid communication with the cooling fluid inlet reservoir 19, and the opposite end of each of the tubes 24 is in fluid communication with the cooling fluid outlet reservoir 21. A cooling fluid, such as water, enters the assembly 10 through the cooling fluid inlet 18. The cooling fluid flows directly into the cooling fluid inlet reservoir 19. From the cooling fluid reservoir 19. The cooling fluid flows into each of the tubes 24. The cooling fluid subsequently exits each tube 24 and flows into the cooling fluid outlet reservoir 21. Finally, the cooling fluid flows from the outlet reservoir 21 to the cooling fluid outlet 20, where it exits the assembly 10.

The assembly 10 further includes a plurality of fins 26. The fins 26 are adapted for disposition within the housing 12. The baffles 22 are sandwiched between some of the fins 26. Several fins 26 are disposed in close relation to each other. The fins 26 comprise a generally flat plate 27 and have a generally linear or flat top and bottom portion and generally curved edges. The curved edges engage the interior walls of the housing 12. This prevents the hot fluid from flowing around the edges of the fin 26. The top and bottom edges do not engage the housing 12 (as can best be seen in FIG. 1). This configuration permits the hot fluid to pass over the top and under the bottom of each fin. The fins 26 have a plurality of holes 28 therethrough. The tubes 24 extend through the holes 28. The fins 26 are positioned in the housing 12 between the cooling fluid inlet reservoir 19 and cooling fluid outlet reservoir 21.

The fins 26 comprise generally a flat plate 27 and include a plurality of undulations generally indicated at 30. The undulations 30 are preferably of equal size and project in only one direction from the fin. However, it will be appreciated that the undulations 30 may be of unequal size. Further, the undulations 30 may project in either direction from the fin 26.

Figure 5:
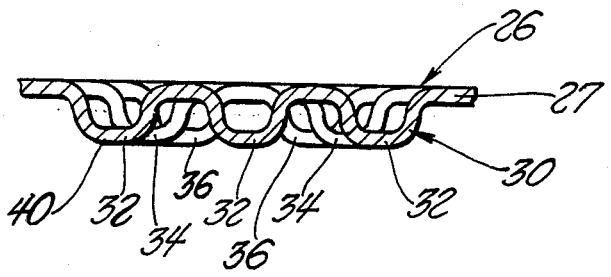
FIG. 5 is a cross-sectional view taken substantially along lines 5—5 of FIG. 3.
Figure 3:
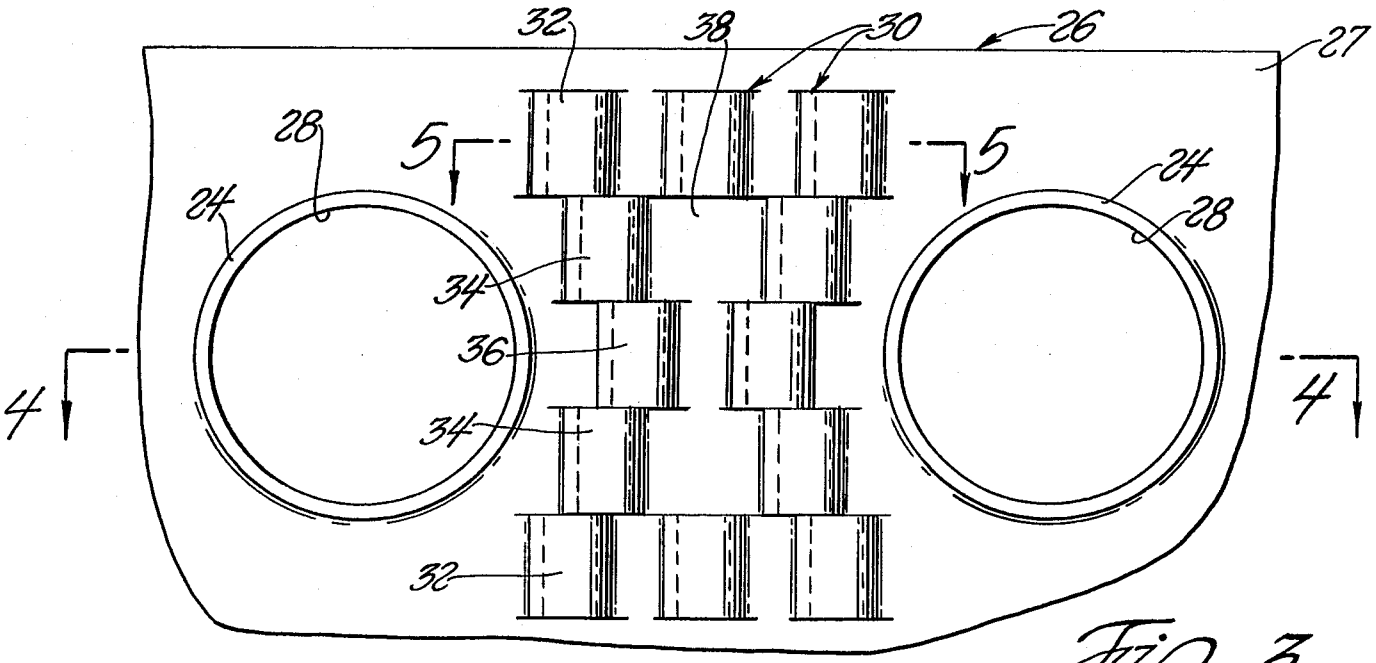
FIG. 3 is an enlarged fragmentary view of the area 3 of FIG. 2.
Figure 4:
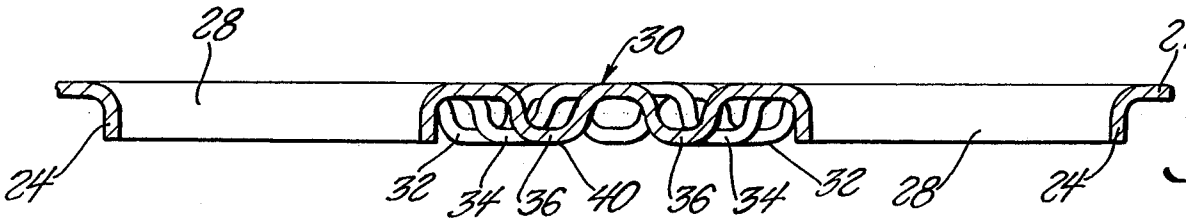
FIG. 4 is a cross-sectional view taken substantially along lines 4—4 of FIG. 3.

The undulations 30 are arranged in rows 32, 34, 36 between adjacent of the holes 28. The undulations 30 are spaced from one another along the rows 32, 34, 36 with the spacing between adjacent undulations 30 varying from one the rows 32, 34, 36 to the next of said rows 32, 34, 36. The undulations are offset from the one of the rows 32, 34, 36 to another one of the rows 32, 34, 36. In other words, the crests 40 of the undulations 30 of adjacent rows 32, 34, 36 are not in line in a direction parallel to the width of the fin (as can best be seen in FIG. 5). The rows, 32, 34, 36 engage one another. That is, the undulations 30 are all interconnected to provide for a greater heat transfer surface area. It is important that the crests of the undulations 30 are offset from each other and that the rows 32, 34, 36 engage one another. Also, the crests 40 are available as surface area for heat transfer from the hot fluid. This results in efficient heat transfer, by continuously interrupting the boundary layer as will be described subsequently.

Alternate of the rows 32, 34, 36 include a flat portion 38 between the undulations 30. The first 32 of the rows comprises three of the undulations 30 disposed immediately adjacent one another. The second 34 of the rows comprises two undulations 30 and has a flat portion 38 therebetween. A third 36 of the rows comprises two of the undulations 30 immediately adjacent one another.

Figure 2:
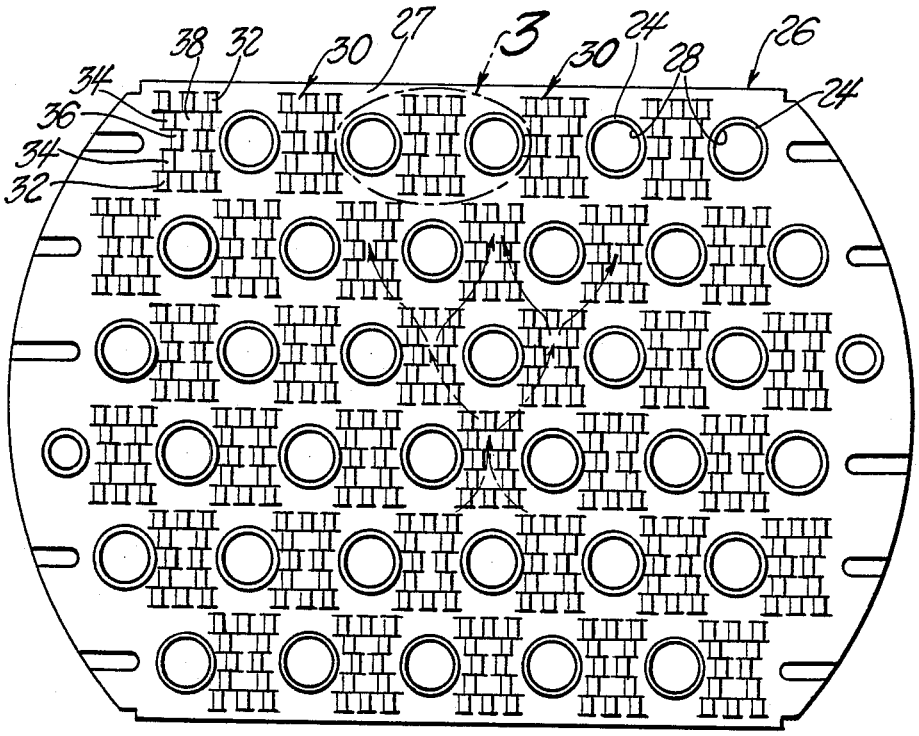
FIG. 2 is a plan of a fin made in accordance with the present invention.

The ends of rows 32, 34, 36 are disposed in an arc about the adjacent of the tubes 28. Because of this arc pattern, the hot fluid, as it passes over the fin 26, and around the tubes 24 is constantly being directed over and through the undulations 30. The flow of hot fluid over the fin 26 is generally indicated by the arrows in FIG. 2.

The undulations 30 continuously interrupt the formation of a boundary layer in the hot fluid flowing along the fin. The boundary layer is the region in the flow near the plate 27 where the velocity of the fluid is slowed by viscous forces. If undisturbed, the fluid flow in the boundary layer is laminar and will grow into a thick layer, resulting in poor heat transfer. This interruption of the boundary layer caused by the undulations 30 results in thinning the boundary layer by retarding its growth and in the creation of turbulence by mixing of the fluid from one side of the fin to another and by mixing the fluid in a lateral direction between adjacent of the undulations 30, promoting a more efficient heat transfer. The undulation pattern enhances fluid to flow from one side of the fin to the other and around adjacent undulations 30, thus impeding the formation of a thick laminar boundary layer.

In operation, hot fluid, such as oil, flows into the hot fluid inlet 14 of the assembly 10. A cooling fluid, such as water, enters the assembly 10 through the cooling fluid inlet 18. The cooling fluid flows into the cooling fluid inlet reservoir 19 and is subsequently directed to flow into each of the tubes 24. The hot fluid flows over the fins 26 and over the tubes 24. As the hot fluid flows over the fins 26, the formation of a boundary layer is continuously interrupted by the undulations 30 on the fins 26. These undulations induce turbulence in the hot fluid to promote a greater transfer. Further, the crests 40 of the undulations 30 are available as surface area, to promote a greater heat transfer. The hot fluid is directed by baffles 22 to flow over the tubes a number of times. This creates a multiple pass heat exchanger. FIG. 1 shows three baffles. The flow of hot fluid is as indicated by the arrows in FIG. 1. Thus, the flow of hot fluid is directed over the tubes 24 four times before it exits at the heat fluid outlet 16. The cooling fluid finally exits the tubes 24 and flows into the cooling fluid outlet reservoir 21. From the cooling fluid outlet reservoir, the cooling fluid flows through the cooling fluid outlet 20.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly (10) of the tube-fin type comprising: a housing (12); a plurality of fins (26) having a plurality of holes (28) therethrough, a plurality of tubes (24) adapted for disposition within said housing (12) and extending through said holes (28); said assembly (10) characterized by said fins (26) including a plurality of undulations (30) arranged in rows (32, 34, 36) between adjacent of said holes (28) and spaced from one another along said rows (32, 34, 36) with the spacing between adjacent undulations (30) varying from one of said rows (32, 34, 36) to the next of said rows (32, 34, 36) and each of said rows (32, 34, 36) including a flat portion (38) of said fin between said undulations (30).

2. An assembly as set forth in claim 1 further characterized by said undulations (30) being offset from one of said rows (32, 34, 36) to another one of said rows.

3. An assembly as set forth in claim 2 further characterized by the ends of said rows (32, 34, 36) being disposed in an arc about adjacent of said holes (28).

4. An assembly as set forth in claim 3 further characterized by said rows (32, 34, 36) engaging one another.

5. An assembly as set forth in claim 4 further characterized by said undulations (30) projecting outwardly from said fin (26).

6. An assembly as set forth in claim 5 further characterized by a first (32) of said rows comprising three of said undulations (30) immediately adjacent one another, a second (34) of said rows comprising two of said undulations (30) with one of said a flat portions (38) therebetween, and a third (36) of said rows comprising two of said undulations (30) immediately adjacent one another.

7. An assembly as set forth in claim 6 further characterized by said tubes (24) having a substantially circular cross-section.

8. An assembly as set forth in claim 7 further characterized by said tubes (24) being disposed parallel to each other within said housing (12).

9. An assembly as set forth in claim 8 further characterized by said housing (12) being generally cylindrical and having a hot fluid inlet (14), a hot fluid outlet (16), a cooling fluid inlet (18), and a cooling fluid outlet (20).

10. An assembly as set forth in claim 9 further characterized by said housing further including a plurality of baffles disposed therein for directing the flow of the hot fluid over said tubes (24).

11. An assembly as set forth in claim 10 further characterized by said housing further including a cooling fluid inlet reservoir (19) and a cooling fluid outlet reservoir 21, said tubes (24) extending between said inlet reservoir (19) and said outlet reservoir (21).

12. A fin (26) for use in a heat exchanger of the tube-fin type comprising a generally flat plate (27) including a plurality of holes (28) therethrough for supporting a plurality of tubes (24), and characterized by including a plurality of undulations (30) arranged in rows (32, 34, 36) between adjacent of said holes (28) and spaced from one another along said rows (32, 34, 36) with the spacing varying from one of said rows (32, 34, 36) to the next of said rows (32, 34, 36) and each said rows (32, 34, 36) including a flat portion (38) of said fin (26) between said undulations (30).

13. A fin as set forth in claim 12 further characterized by said undulations (30) being offset from one of said rows (32, 34, 36) to another one of said rows (32, 34, 36).

14. A fin as set forth in claim 13 further characterized by the ends of said rows (32, 34, 36) being disposed in an arc about adjacent of said holes (28).

15. A fin as set forth in claim 14 further characterized by said rows (32, 34, 36) engaging one another.

16. A fin as set forth in claim 15 further characterized by said undulations (30) projecting from said fin (26).

17. A fin as set forth in claim 16 further characterized by a first (32) of said rows comprising three of said undulations (30) immediately adjacent one another, a second (34) of said rows comprising two of said undulations (30) with a flat portion (38) therebetween, and a third (36) of said rows comprising two of said undulations (30) immediately adjacent one another.

* * * * *